US005450788A

United States Patent [19]

Shan

[11] Patent Number: 5,450,788

[45] Date of Patent: Sep. 19, 1995

[54] PRINTER FOR PLASTIC BAGS

[76] Inventor: Chen C. Shan, No. 33, Fu Chiang Rd., Hsin Ho Tsun, Hsin Shih Hsiang, Tainan Hsien, Taiwan

[21] Appl. No.: 287,405

[22] Filed: Aug. 5, 1994

[51] Int. Cl.[6] ..... B41F 17/00

[52] U.S. Cl. ..... 101/37; 101/248; 101/DIG. 36

[58] Field of Search ..... 101/36, 37, 153, 216, 101/248, 35, 174, 175, 176, 247, 484, 485, 486, DIG. 36

[56] References Cited

U.S. PATENT DOCUMENTS

| | | | |
|---|---|---|---|
| 3,552,308 | 1/1971 | Minehart | 101/37 |
| 3,915,090 | 10/1975 | Horst et al. | 101/DIG. 36 |
| 4,079,669 | 3/1978 | Nyborg | 101/37 |
| 4,484,522 | 11/1984 | Simeth | 101/248 |
| 4,899,655 | 2/1990 | Seo et al. | 101/248 X |
| 5,127,324 | 7/1992 | Palmatier et al. | 101/248 |

*Primary Examiner*—Chris A. Bennett

*Attorney, Agent, or Firm*—Morton J. Rosenberg; David I. Klein

[57] ABSTRACT

An improved printer for plastic bags is provided. The improvement includes a counter which is incremented responsive to rotation of an upper wheel of a feeder. The counter enables a clutch. The clutch couples a driving wheel to the shaft of the rotating upper wheel. The driving wheel drives a blanket wheel through one revolution to print a design on a plastic bag. A photoelectric switch senses the one revolution of the blanket wheel and resets the counter, disengaging the clutch and enabling a brake to stop further rotation of the blanket wheel.

1 Claim, 4 Drawing Sheets

PRINTER FOR PLASTIC BAGS

BACKGROUND OF THE INVENTION

1. Field of the Invention

This invention relates to a printer and more particularly to a plastic bag printer.

2. Prior Art

A prior art printer is shown in FIG. 4. Such prior art printers include an upper rotary wheel A and a lower rotary wheel B that allow plastic bags to be fed therebetween. A blanket wheel C receives the engraved design and prints such on plastic bags. A plate wheel D carries the engraved design and transfers that design with the ink received from a wheel E to the blanket wheel C. The wheel E is disposed partially in an ink tank E1. A plurality of adjusting screws F are provided to adjust the interface between the wheels. The circumferential size of the blanket wheel C is equal to the length of each plastic bag G to be printed. Therefore, every time the blanket wheel C rotates through a cycle, each plastic bag G receives the printed design. However, if plastic bags G to be printed have a different length, then the blanket cylinder C should be changed to one that has a different circumferential size, to match the bag length. Otherwise, the engraved design will be printed on the plastic bags G unevenly.

SUMMARY OF THE INVENTION

It is the primary object of the present invention to provide a printer for plastic bags which utilizes a photoelectric switch to control the rotation of the blanket wheel for printing.

It is another object of the present invention to provide a printer for plastic bags which does not require that the blanket wheel be changed to print plastic bags having different lengths.

It is a further object of the present invention to provide a printer for plastic bags which can print engraved designs on plastic bags precisely.

DETAILED DESCRIPTION OF THE PREFERRED EMBODIMENT

Figure 1:
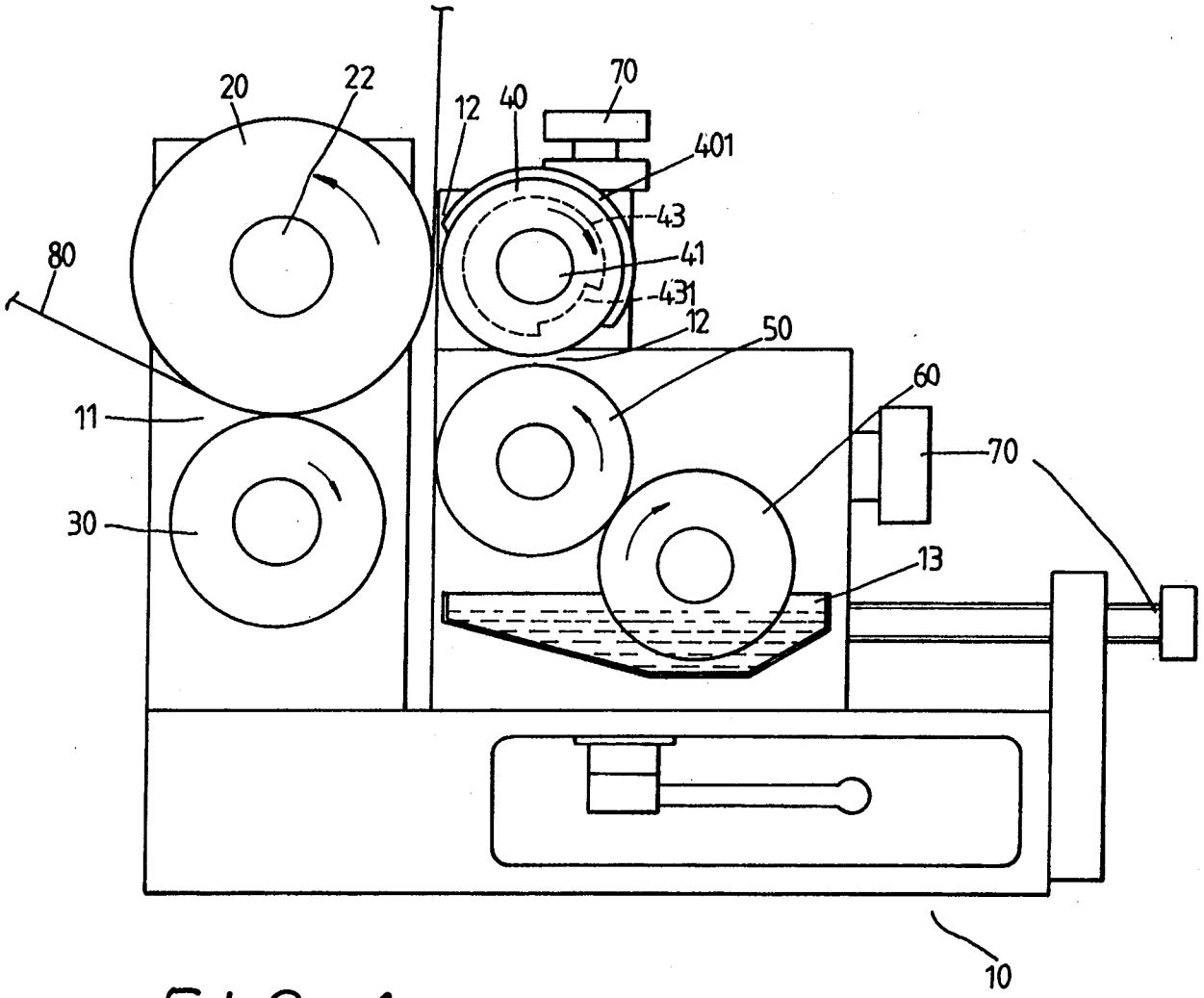
FIG. 1 is a side elevation view, partially sectioned, of a printer according to the present invention.
Figure 2:
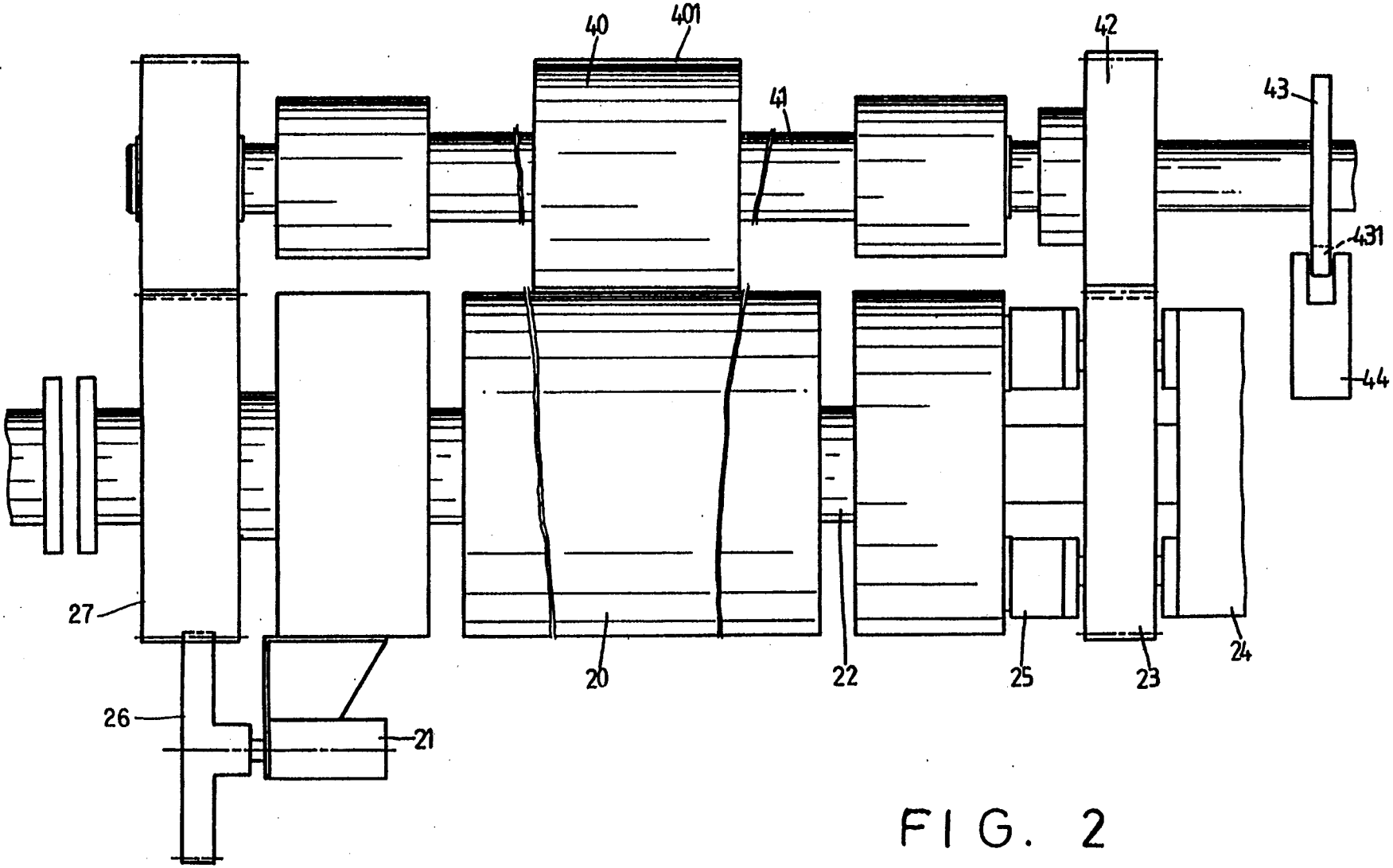
FIG. 2 is a top plan view of a portion of FIG. 1.

Reference is now made to the drawings wherein each showing is for the purpose of illustrating a preferred embodiment only, and not for the purpose of limiting the scope of the invention. FIGS. 1 and 2 show the present invention as having a feeder 11 essentially composed of an upper rotary wheel 20 and a lower rotary wheel 30 for plastic bags to be fed therefrom into the printer. A blanket wheel 40 is detachably affixed to the printer adjacent to the upper rotary wheel 20. The blanket wheel 40 is adapted to provide an offset printing of an engraved design which is transferred from a plate wheel 50. The engraved design on plate wheel 50 receives ink from an ink wheel 60, which is disposed partially in an ink tank 13. A plurality of adjusting screws 70 are adapted to adjust the clearances 12 which are formed between the blanket wheel 40, the upper rotary wheel 20 and the plate wheel 50. A counter 21, which is resettable, is connected to the upper rotary wheel 20 by the driven wheel 26 meshed with the driving wheel 27 to count the incremental rotation of the upper wheel 20. An upper wheel axle 22 selectively engages a driving wheel 23, through a clutch 24 and a brake 25. A driven wheel 42 is connected to an axle 41 of the blanket cylinder 40 and adapted to be meshed with a driving wheel 23 of the upper rotary wheel 20. A disc 43 having a notch 431 is connected to one end of the axle 41 for rotation therewith. The disc 43 rotates through a photoelectric switch 44.

Figure 3:
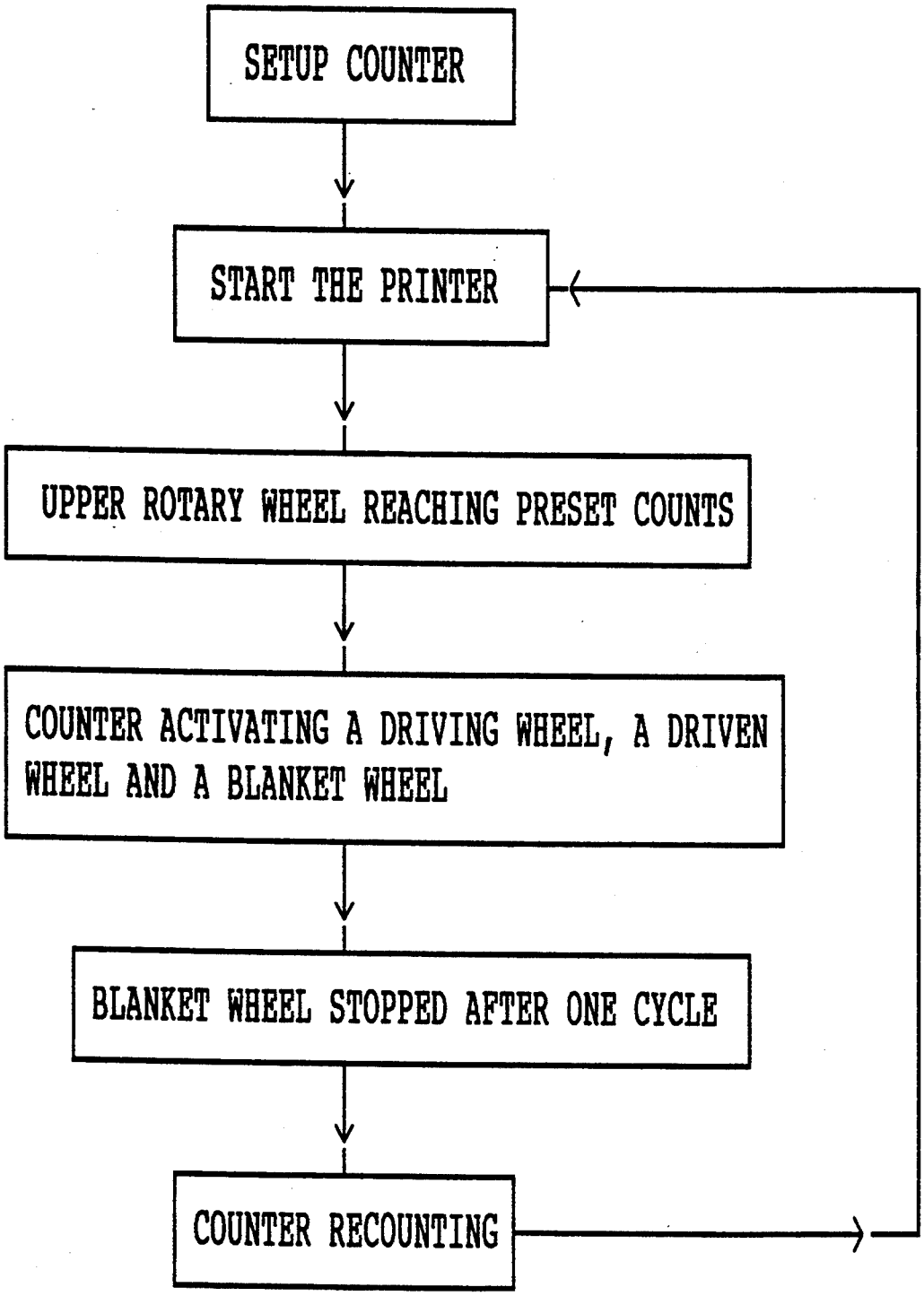
FIG. 3 is a block diagram of the operation of the present invention.
Figure 4:
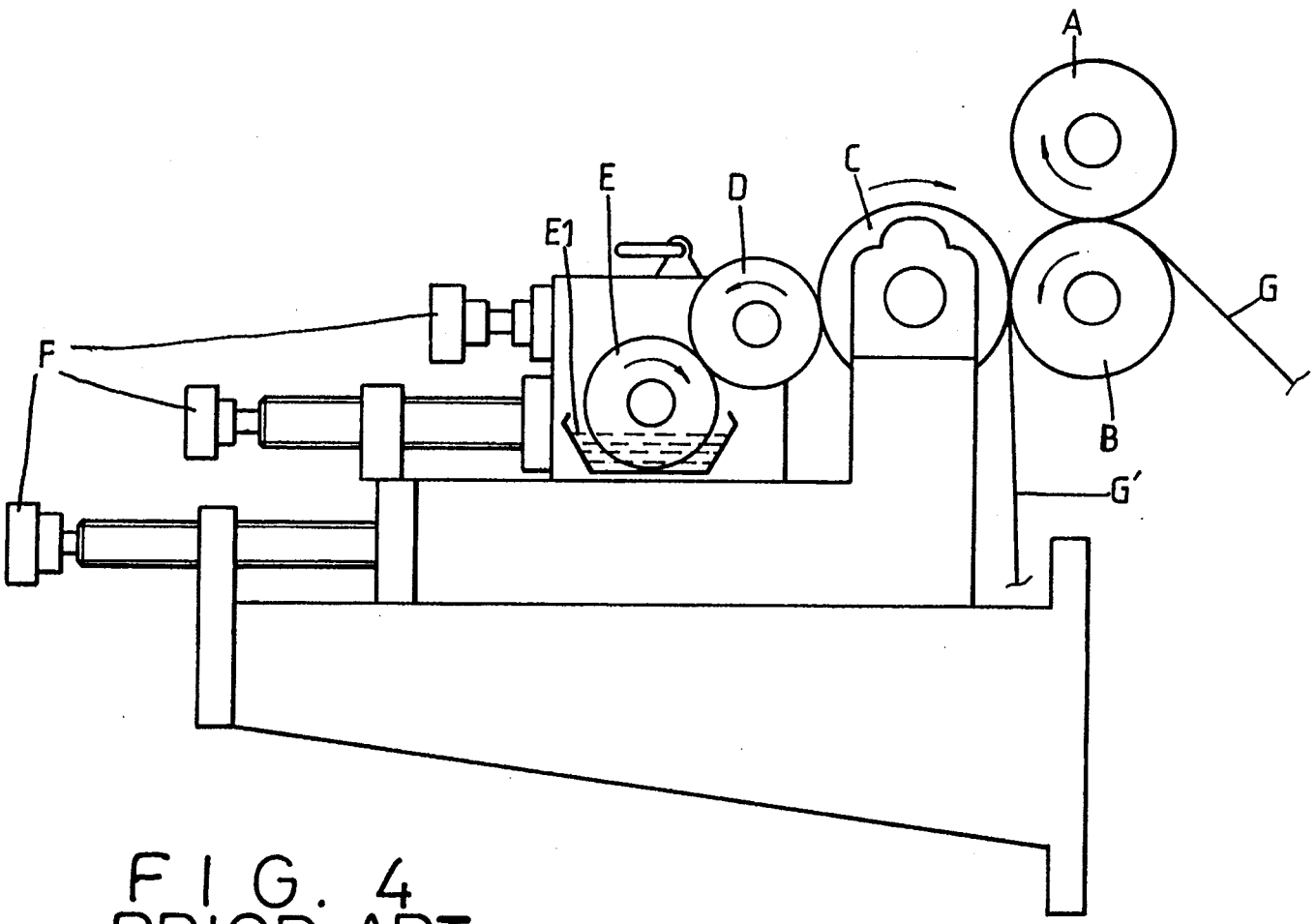
FIG. 4 PRIOR ART
FIG. 4 is a side elevation view, partially sectioned, of a prior art printer.

In operation, the counter 21 is preset to a desired count before the printer is started. When the printer starts, the upper and the lower rotary wheels 20 and 30 will rotate in opposite directions that will bring the plastic bags into the printer. The counter 21 will count the rotation of the upper rotary wheel 20. When the rotation of the upper rotary wheel 20 has reached the predetermined count, the counter 21 will activate the clutch 24 on the axle 22, thereby coupling the driving wheel 23 with the shift 22. The driving wheel 23 thereby drives the driven wheel 42 of the blanket wheel 40, causing the blanket wheel to rotate. Rotation of the blanket wheel 40 allows the inked design 401 transferred from the plate wheel 50 to be offset onto the plastic bag 80. The disc 43 will rotate with the blanket wheel 40 and will block passage of the light of the photoelectric switch 44 until the notch 431 is reached. Upon the notch 431 reaching the position where the light of the photoelectric switch 44 is not blocked, the clutch 24 will be disengaged from the driving wheel 23 and the brake 25 activated to engage the driving wheel 23 until the driving wheel 23 and the driven wheel 42 are stopped. The sensing of the notch 431 by the photoelectric switch 44 also resets the counter 21, as indicated in the block diagram of FIG. 3. With the counter reset, a predetermined length of the next plastic bag is fed into the printer. Again when the predetermined count is reached, the brake 25 is released and the clutch is enabled to cause the blanket wheel to rotate through another full rotation.

I claim:

1. A printer for plastic bags having a feeder for conveying the plastic bags, said feeder including an upper rotary wheel and a lower rotary wheel disposed in vertically spaced relationship and respectively driven for displacing the plastic bags therebetween, said upper rotary wheel being coupled to an first axle for rotation therewith, the improvement comprising:

a driving wheel pivotally coupled to said first axle;

a clutch coupled to said first axle for selectively coupling said driving wheel to said first axle for rotation therewith responsive to a first control signal, said clutch disengaging said driving wheel responsive to a second control signal;

means for braking rotation for said driving wheel responsive to said second control signal, said braking means being disposed adjacent said driving wheel;

a second axle disposed in spaced parallel relation to said first axle;

a blanket wheel rotatively coupled to said second axle for transferring an inked design to a plastic bag passing between said blanket wheel and said upper rotary wheel;

a driven wheel rotatively coupled to said second axle and disposed in meshing relationship with said driving wheel for corresponding rotation therewith;

an optical switch coupled to said second axle for sensing each revolution thereof, said optical switch including (1) a disc-shaped member coupled to said second axle for rotation therewith, said disc-shaped member having a notch formed in a peripheral edge portion thereof, and (2) a photoelectric sensor having an opening for passage of said disc-shaped member therethrough for detecting a full revolution of said blanket wheel by passage of said notch, said photoelectric sensor being coupled to said clutch and said braking means for output of said second control signal thereto responsive to detection of said notch;

means for counting incremental rotational displacement of said upper rotary wheel electrically coupled to said clutch, said counting means generating said first control signal responsive to an incremental count reaching a predetermined value, said counting means having an input coupled to said photoelectric sensor for resetting said incremental count responsive to said second control signal.

* * * * *